US009812011B1

(12) United States Patent
Stenneth et al.

(10) Patent No.: US 9,812,011 B1
(45) Date of Patent: Nov. 7, 2017

(54) DANGEROUS DRIVING WEATHER MESSAGES

(71) Applicant: HERE Global B.V., Eindhoven (NL)

(72) Inventors: Leon Stenneth, Chicago, IL (US); Michael Weinberger, Geneva, IL (US)

(73) Assignee: HERE Global B.V., Eindhoven (NL)

( * ) Notice: Subject to any disclaimer, the term of this patent is extended or adjusted under 35 U.S.C. 154(b) by 0 days.

(21) Appl. No.: 15/221,846

(22) Filed: Jul. 28, 2016

(51) Int. Cl.
*G08G 1/09* (2006.01)
*G08G 1/0967* (2006.01)

(52) U.S. Cl.
CPC ..... *G08G 1/0967* (2013.01)

(58) Field of Classification Search
CPC ..... G08G 1/0967
See application file for complete search history.

(56) References Cited

U.S. PATENT DOCUMENTS

| | | | | |
|---|---|---|---|---|
| 5,121,430 | A * | 6/1992 | Ganzer | G08B 27/008 348/E7.025 |
| 6,462,665 | B1 | 10/2002 | Tarlton et al. | |
| 7,949,330 | B2 | 5/2011 | Yuhara et al. | |
| 8,200,247 | B1 * | 6/2012 | Starenky | G01C 21/28 455/404.2 |
| 8,370,062 | B1 * | 2/2013 | Starenky | H04W 4/025 340/3.3 |
| 8,816,876 | B2 | 8/2014 | Jones et al. | |
| 9,024,786 | B1 | 5/2015 | Jones et al. | |
| 2004/0080430 | A1 | 4/2004 | Videtich | |
| 2005/0027449 | A1 * | 2/2005 | Marsh | G08B 21/10 701/515 |
| 2007/0210938 | A1 * | 9/2007 | Deurwaarder | G01C 21/26 340/995.21 |

(Continued)

OTHER PUBLICATIONS

Rothfusz, Lans P., et al., "A Future Watch/Warning Concept: Forecasting a Continuum of Environmental Threats (FACETs)", Proceedings of American Meteorological Society FACETs 2014, Feb. 4, 2014, 25 pages, Atlanta, Georgia, retrieved from <http://www.nssl.noaa.gov/projects/facets/FACETs_AMS_2014.pptx> on Jan. 11, 2017.

(Continued)

*Primary Examiner* — Erin File
(74) *Attorney, Agent, or Firm* — Alston & Bird LLP

(57) ABSTRACT

Methods, apparatuses, systems, and computer program products for providing dangerous driving weather messages in a tile-based system are provided. An example method comprises receiving one or more measurements of one or more weather parameters for a geographic area. The geographic area is represented by a plurality of tiles. The method further comprises processing at least one of the measurements of at least one of the one or more weather parameters to determine a dangerous driving weather score for at least a first tile of the plurality of tiles; identifying a first tile of the plurality of tiles that is experiencing dangerous driving weather based on the dangerous driving weather score for the first tile; generating a dangerous driving weather message; and providing the dangerous driving weather message. The dangerous driving weather message comprises a timestamp, a list of one or more affected tile identifiers, an alert type, and alert information.

20 Claims, 10 Drawing Sheets

(56) References Cited

U.S. PATENT DOCUMENTS

| | | | | |
|---|---|---|---|---|
| 2012/0062392 | A1* | 3/2012 | Ferrick | G08G 1/096716 340/905 |
| 2012/0259537 | A1* | 10/2012 | Schmidt | A01B 69/00 701/300 |
| 2014/0225750 | A1 | 8/2014 | Sloop et al. | |
| 2015/0134252 | A1 | 5/2015 | Marshall et al. | |
| 2015/0256277 | A1* | 9/2015 | Johnson | H04L 51/14 340/601 |
| 2015/0277841 | A1* | 10/2015 | Lanier | G06F 3/014 345/428 |
| 2015/0294422 | A1* | 10/2015 | Carver | G06Q 40/08 705/4 |
| 2015/0344038 | A1 | 12/2015 | Stenneth et al. | |
| 2015/0351073 | A1* | 12/2015 | Ball | H04W 4/001 455/414.2 |

OTHER PUBLICATIONS

U.S. Appl. No. 15/077,507, "Selecting a Weather Estimation Algorithm and Providing a Weather Estimate", Unpublished (filed Mar. 22, 2016), (Leon Oliver Stenneth, Inventor) (HERE Global B.V., assignee).

* cited by examiner

FIG. 8

150'

152'

```
<CDDWM message>
        <message_id> 5737 </message_id>
        <observation_time>
                03/24/2016 12:14:34
        </observation_time>

        <message_creation_time>
                03/24/2016 12:24:34
        </message_creation_time>

        <tiles_affected>
                1,2,3,4,5,188,189,1006,1007,1009
        </tiles_affected>

        <alert_type>
                <precipitation_intensity_cmh>
                        <average>
                                2.05
                        </average>
                        <standard_deviation>
                                0.05
                        </standard_deviation>
                </precipitation_intensity_cmh>
        </alert_type>

        <alert_type>
                <visibility_km>
                        <average>
                                1.65
                        </average>
                        <standard_deviation>
                                0.135
                        </standard_deviation>
                </visibility_km>
        </alert_type>

        <alert_type>
                <pavement_condition>
                        slippery_frost
                </pavement_condition>
        </alert_type>
</CDDWM message>
```

154'

156'

158'

160a'

162a'

160b'

162b'

160c'

162c'

DANGEROUS DRIVING WEATHER MESSAGES

TECHNOLOGICAL FIELD

Example embodiments relate generally to providing dangerous driving weather messages. In particular, example embodiments relate to providing dangerous driving weather messages using a tile-based system.

BACKGROUND

In general, severe weather warnings are provided by city or county. However, weather conditions in one part of a city or county may be significantly different than weather conditions in another part of the city or county. Moreover, severe weather warnings are focused on the weather and safety concerns regarding the weather itself, rather than the impact of weather on driving conditions. Thus, city or county based severe weather warnings may not provide drivers or individuals considering driving sufficient and/or specific enough information regarding driving conditions related to weather.

BRIEF SUMMARY

Example embodiments provide current or expected/predicted dangerous driving weather messages in a tile-based system. In example embodiments, a dangerous driving weather score is determined for each tile based on weather information/data received from one or more weather stations. Tiles that are experiencing dangerous driving weather may then be identified, for example, based on the dangerous driving weather scores corresponding to the tiles. In some embodiments, clusters of tiles that are experiencing dangerous driving weather may be defined. Dangerous driving weather messages may then be generated and provided for the tiles and/or clusters of tiles identified as experiencing dangerous driving weather.

Methods, apparatus, and computer program products are provided in accordance with an example embodiment in order to determine a map update. In example embodiments, one or more measurements of one or more weather parameters for a geographic area are received. The geographic area is represented by a plurality of tiles. At least one of the measurements of at least one of the one or more weather parameters is processed to determine a dangerous driving weather score for a least a first tile of the plurality of tiles. The first tile of the plurality of tiles is identified as experiencing dangerous driving weather based on the dangerous driving weather score for the first tile. A dangerous driving weather message is generated. The dangerous driving weather message comprises a timestamp, a list of one or more affected tile identifiers, an alert type, and alert information. The dangerous driving weather message is provided.

In accordance with an example embodiment, a method is provided. The method comprises receiving one or more measurements of one or more weather parameters for a geographic area. The geographic area is represented by a plurality of tiles. The method may further comprise processing at least one of the measurements of at least one of the one or more weather parameters to determine a dangerous driving weather score for at least a first tile of the plurality of tiles. The method may further comprise identifying a first tile of the plurality of tiles that is experiencing dangerous driving weather based on the dangerous driving weather score for the first tile. The method may further comprise generating a dangerous driving weather message. The dangerous driving weather message comprises a timestamp, a list of one or more affected tile identifiers, an alert type, and alert information. The method may further comprise providing the dangerous driving weather message.

In example embodiments, the method further comprises identifying one or more tiles adjacent to the first tile, wherein the one or more tiles are identified as experiencing dangerous driving weather. The method may further comprise defining a cluster, wherein the cluster comprises the first tile and the one or more tiles adjacent the first tile identified as experiencing dangerous driving weather. The list of one or more affected tile identifiers of the dangerous driving weather message comprises a tile identifier of each tile in the cluster. In example embodiments, the method further comprises identifying one or more tiles adjacent to the cluster that are identified as experiencing dangerous driving weather; and adding the one or more tiles adjacent to the cluster that are identified as experiencing dangerous driving weather to the cluster. In an example embodiments, each tile in the cluster shares a boundary with at least one other tile in the cluster. In an example embodiment, the method further comprises identifying one or more nearby tiles that are identified as experiencing dangerous driving weather; and adding (a) the one or more nearby tiles that are identified as experiencing dangerous driving weather and (b) at least one adjoining tile corresponding to each nearby tile identified as experiencing dangerous driving weather to the cluster. An adjoining tile is a tile that shares (i) at least one boundary with a tile in the cluster and (ii) a boundary with a nearby tile. A nearby tile is a tile that (i) does not share a boundary with a tile in the cluster and (ii) does share a boundary with an adjoining tile. In an example embodiment, the alert information comprises at least one statistical representation of the severe weather being experienced in the area represented by the cluster.

In an example embodiment, the dangerous driving weather score for the first tile indicates that one weather condition for the first tile is greater than a corresponding single condition score threshold value. In an example embodiment, the dangerous driving weather score for the first tile indicates that a combination of two or more weather conditions for the first tile is greater than a corresponding combined condition score threshold value. In an example embodiment, the dangerous driving weather message is configured to expire after a predetermined period of time. In an example embodiment, the dangerous driving weather message is provided to an intermediary system for distribution to a mobile device based on at least one tile identifier listed in the list of one or more affected tile identifiers and a location of the mobile device, wherein the mobile device is associated with the intermediary system. In an example embodiment, the dangerous driving weather message is provided to a mobile device based on a current physical location of the mobile device and at least one tile identifier listed in the list of one or more affected tile identifiers.

In accordance with an example embodiment, an apparatus is provided. The apparatus may comprise at least one processor and at least one memory storing computer program code. The at least one memory and the computer program code configured to, with the processor, cause the apparatus to at least receive one or more measurements of one or more weather parameters for a geographic area. The geographic area is represented by a plurality of tiles. The at least one memory and the computer program code may be further configured to, with the processor, cause the apparatus to at least process at least one of the measurements of at least one of the one or more weather parameters to determine a dangerous driving weather score for at least a first tile of the plurality of tiles. The at least one memory and the computer program code may be further configured to, with the processor, cause the apparatus to at least identify a first tile of the plurality of tiles that is experiencing dangerous driving weather based on the dangerous driving weather score for the first tile. The at least one memory and the computer program code may be further configured to, with the processor, cause the apparatus to at least generate a dangerous driving weather message. The dangerous driving weather message comprises a timestamp, a list of one or more affected tile identifiers, an alert type, and alert information. The at least one memory and the computer program code may be further configured to, with the processor, cause the apparatus to at least provide the dangerous driving weather message.

In example embodiments, the at least one memory and the computer program code may be further configured to, with the processor, cause the apparatus to at least identify one or more tiles adjacent to the first tile, wherein the one or more tiles are identified as experiencing dangerous driving weather. The at least one memory and the computer program code may be further configured to, with the processor, cause the apparatus to at least define a cluster, wherein the cluster comprises the first tile and the one or more tiles adjacent the first tile identified as experiencing dangerous driving weather. The list of one or more affected tile identifiers of the dangerous driving weather message comprises a tile identifier of each tile in the cluster. In example embodiments, the at least one memory and the computer program code may be further configured to, with the processor, cause the apparatus to at least identify one or more tiles adjacent to the cluster that are identified as experiencing dangerous driving weather; and add the one or more tiles adjacent to the cluster that are identified as experiencing dangerous driving weather to the cluster. In an example embodiments, each tile in the cluster shares a boundary with at least one other tile in the cluster. In example embodiments, the at least one memory and the computer program code are further configured to, with the processor, cause the apparatus to at least identify one or more nearby tiles that are identified as experiencing dangerous driving weather; and add (a) the one or more nearby tiles that are identified as experiencing dangerous driving weather and (b) at least one adjoining tile corresponding to each nearby tile identified as experiencing dangerous driving weather to the cluster. An adjoining tile is a tile that shares (i) at least one boundary with a tile in the cluster and (ii) a boundary with a nearby tile. A nearby tile is a tile that (i) does not share a boundary with a tile in the cluster and (ii) does share a boundary with an adjoining tile. In an example embodiment, the alert information comprises at least one statistical representation of the severe weather being experienced in the area represented by the cluster.

In an example embodiment, the dangerous driving weather score for the first tile indicates that one weather condition for the first tile is greater than a corresponding single condition score threshold value. In an example embodiment, the dangerous driving weather score for the first tile indicates that a combination of two or more weather conditions for the first tile is greater than a corresponding combined condition score threshold value. In an example embodiment, the dangerous driving weather message is configured to expire after a predetermined period of time. In an example embodiment, the dangerous driving weather message is provided to an intermediary system for distribution to a mobile device based on at least one tile identifier listed in the list of one or more affected tile identifiers and a location of the mobile device, wherein the mobile device is associated with the intermediary system. In an example embodiment, the dangerous driving weather message is provided to a mobile device based on a current physical location of the mobile device and at least one tile identifier listed in the list of one or more affected tile identifiers.

In accordance with an example embodiment, a computer program product is provided. The computer program product may comprise at least one non-transitory computer-readable storage medium having computer-executable program code instructions stored therein. The computer-executable program code instructions comprise program code instructions configured to receive one or more measurements of one or more weather parameters for a geographic area. The geographic area is represented by a plurality of tiles. The computer-executable program code instructions further comprise program code instructions configured to process at least one of the measurements of at least one of the one or more weather parameters to determine a dangerous driving weather score for at least a first tile of the plurality of tiles. The computer-executable program code instructions further comprise program code instructions configured to identify a first tile of the plurality of tiles that is experiencing dangerous driving weather based on the dangerous driving weather score for the first tile. The computer-executable program code instructions further comprise program code instructions configured to generate a dangerous driving weather message. The dangerous driving weather message comprises a timestamp, a list of one or more affected tile identifiers, an alert type, and alert information. The computer-executable program code instructions further comprise program code instructions configured to provide the dangerous driving weather message.

In example embodiments, the computer-executable program code instructions further comprise program code instructions configured to identify one or more tiles adjacent to the first tile, wherein the one or more tiles are identified as experiencing dangerous driving weather. The computer-executable program code instructions further comprise program code instructions configured to define a cluster, wherein the cluster comprises the first tile and the one or more tiles adjacent the first tile identified as experiencing dangerous driving weather. The list of one or more affected tile identifiers of the dangerous driving weather message comprises a tile identifier of each tile in the cluster. In example embodiments, the computer-executable program code instructions further comprise program code instructions configured to identify one or more tiles adjacent to the cluster that are identified as experiencing dangerous driving weather; and add the one or more tiles adjacent to the cluster that are identified as experiencing dangerous driving weather to the cluster. In an example embodiments, each tile in the cluster shares a boundary with at least one other tile in the cluster. In example embodiments, the computer-executable program code instructions further comprise program code instructions configured to identify one or more nearby tiles that are identified as experiencing dangerous driving weather; and add (a) the one or more nearby tiles that are identified as experiencing dangerous driving weather and (b) at least one adjoining tile corresponding to each nearby tile identified as experiencing dangerous driving weather to the cluster. An adjoining tile is a tile that shares (i) at least one boundary with a tile in the cluster and (ii) a boundary with a nearby tile. A nearby tile is a tile that (i) does not share a boundary with a tile in the cluster and (ii) does share a boundary with an adjoining tile. In an example embodiment, the alert information comprises at least one statistical representation of the severe weather being experienced in the area represented by the cluster.

In an example embodiment, the dangerous driving weather score for the first tile indicates that one weather condition for the first tile is greater than a corresponding single condition score threshold value. In an example embodiment, the dangerous driving weather score for the first tile indicates that a combination of two or more weather conditions for the first tile is greater than a corresponding combined condition score threshold value. In an example embodiment, the dangerous driving weather message is configured to expire after a predetermined period of time. In an example embodiment, the dangerous driving weather message is provided to an intermediary system for distribution to a mobile device based on at least one tile identifier listed in the list of one or more affected tile identifiers and a location of the mobile device, wherein the mobile device is associated with the intermediary system. In an example embodiment, the dangerous driving weather message is provided to a mobile device based on a current physical location of the mobile device and at least one tile identifier listed in the list of one or more affected tile identifiers.

In accordance with yet another example embodiment of the present invention, an apparatus is provided. The apparatus comprises means for receiving one or more measurements of one or more weather parameters for a geographic area. The geographic area is represented by a plurality of tiles. The apparatus may comprise means for processing at least one of the measurements of at least one of the one or more weather parameters to determine a dangerous driving weather score for at least a first tile of the plurality of tiles. The apparatus may further comprise means for identifying a first tile of the plurality of tiles that is experiencing dangerous driving weather based on the dangerous driving weather score for the first tile. The apparatus may further comprise means for generating a dangerous driving weather message. The dangerous driving weather message comprises a timestamp, a list of one or more affected tile identifiers, an alert type, and alert information. The apparatus may further comprise means for providing the dangerous driving weather message.

BRIEF DESCRIPTION OF THE DRAWINGS

Figure 1:
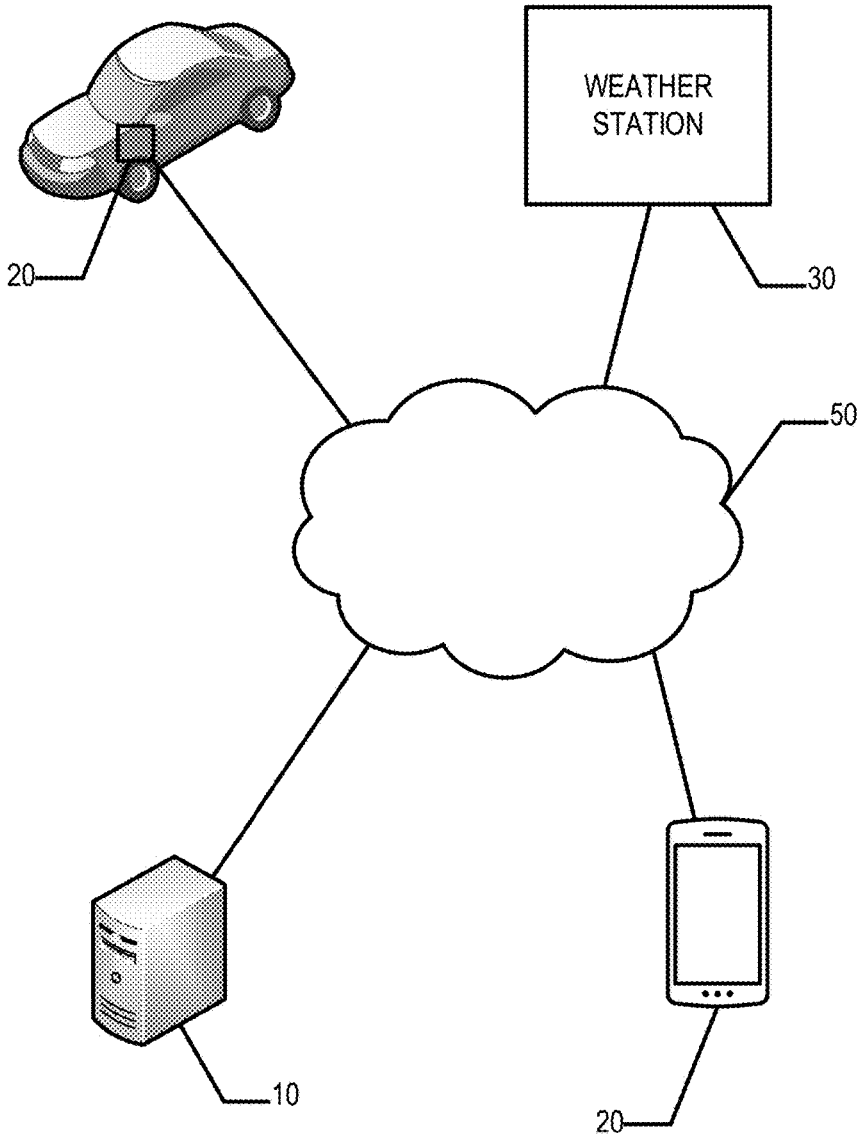
Figure 1A:
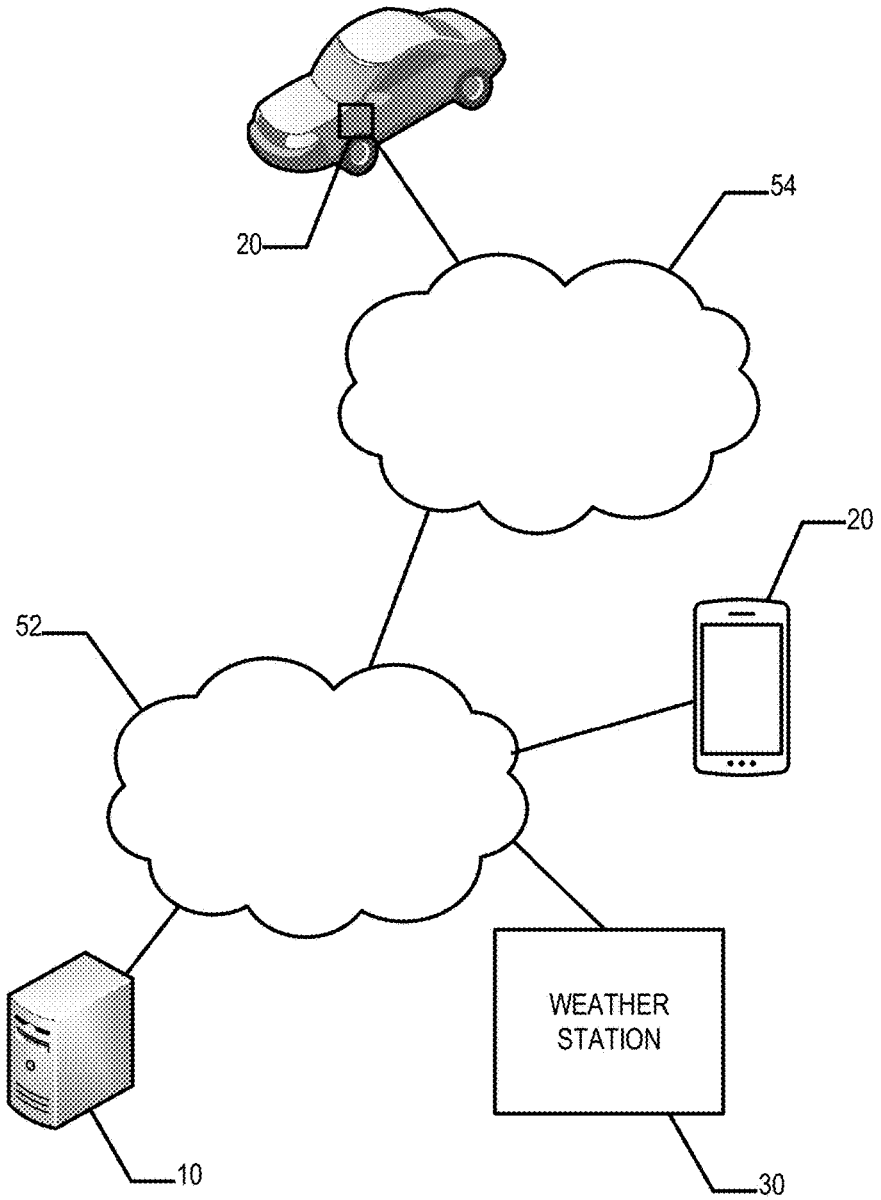
Figure 2:
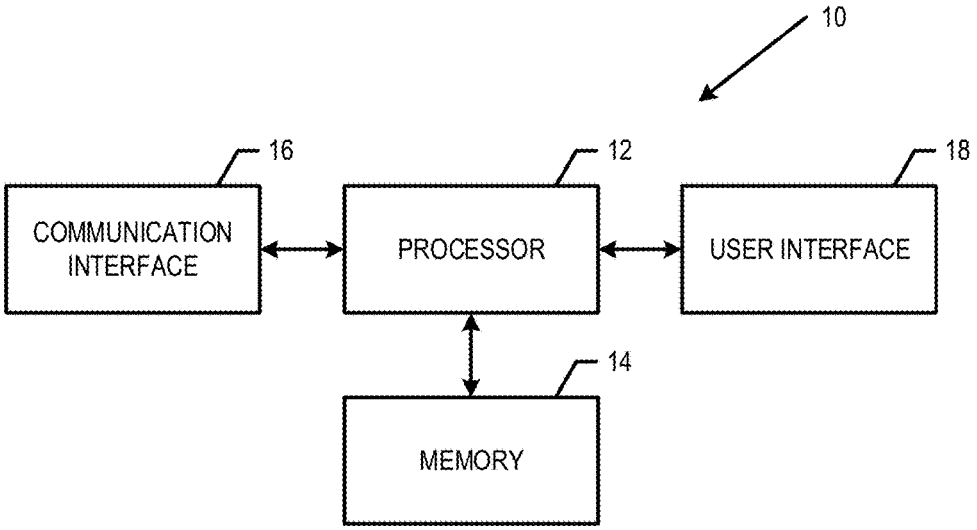
Figure 3:
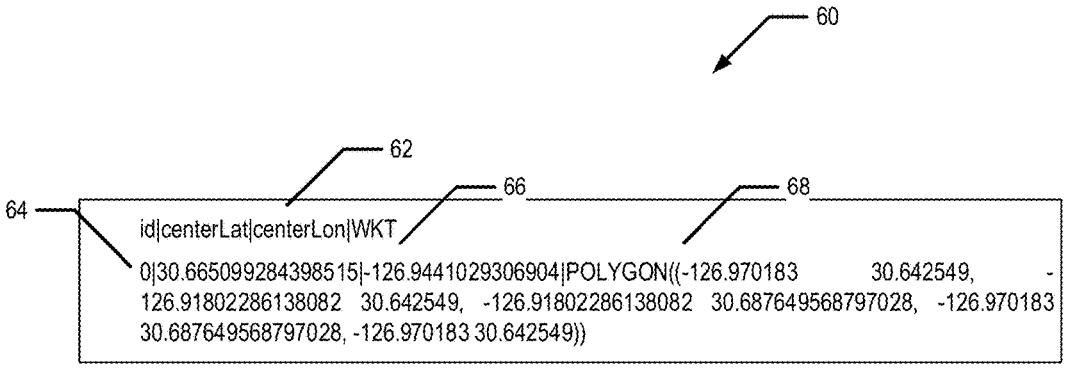
Figure 4:
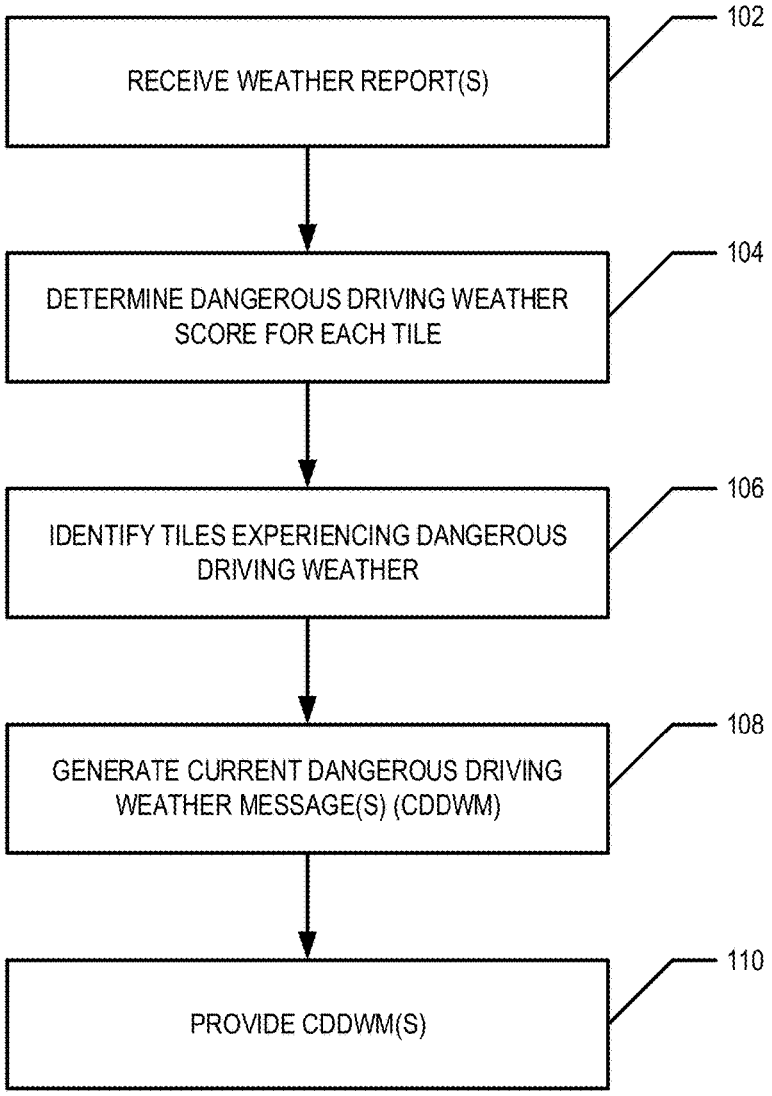
Figure 5:
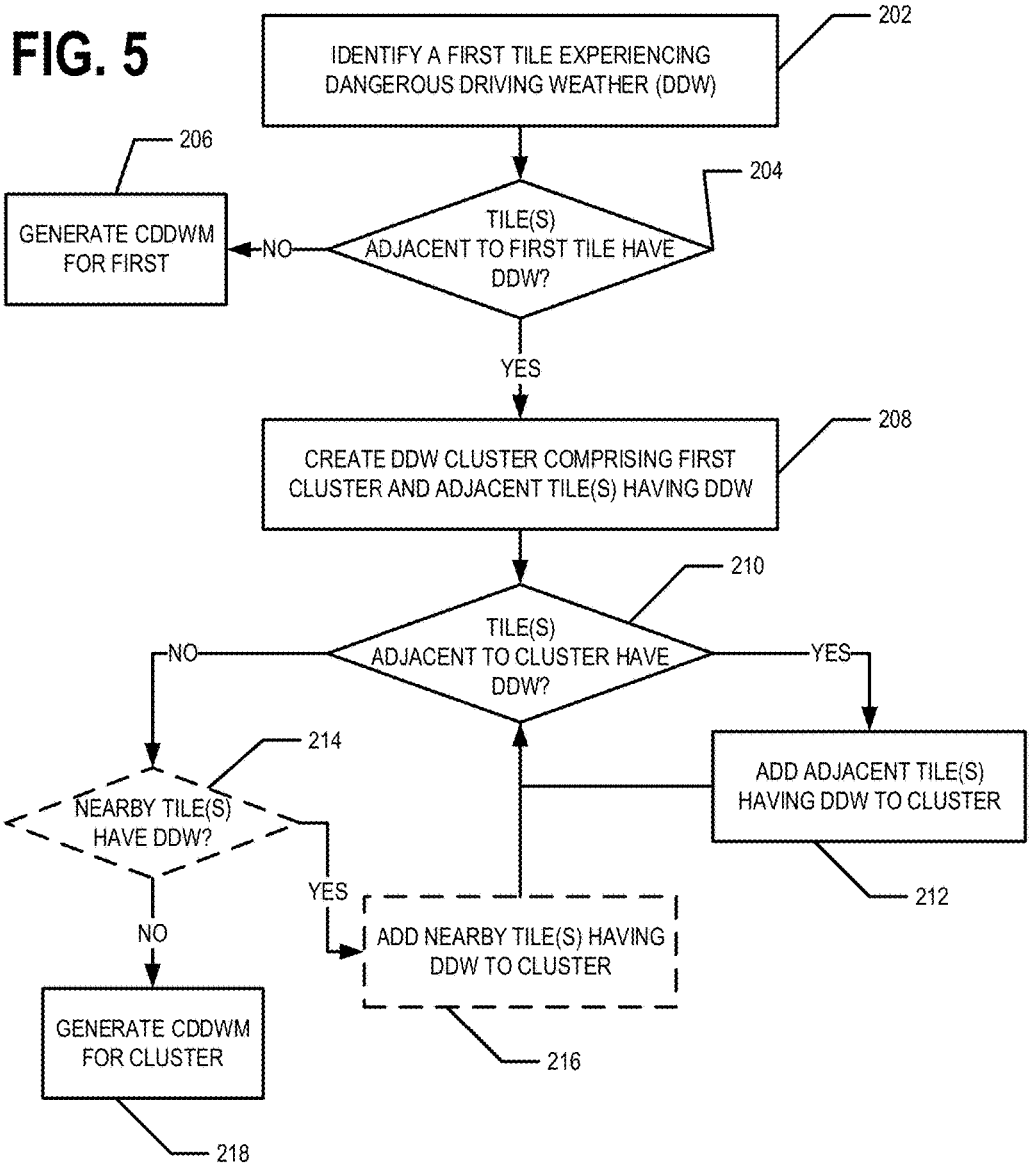
Figure 6:
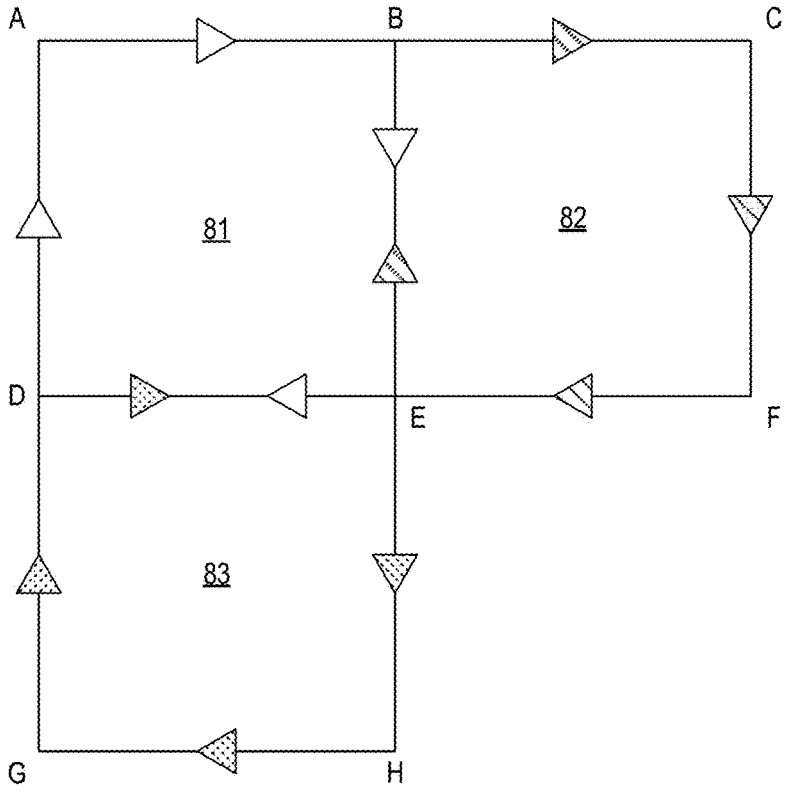
Figure 6A:
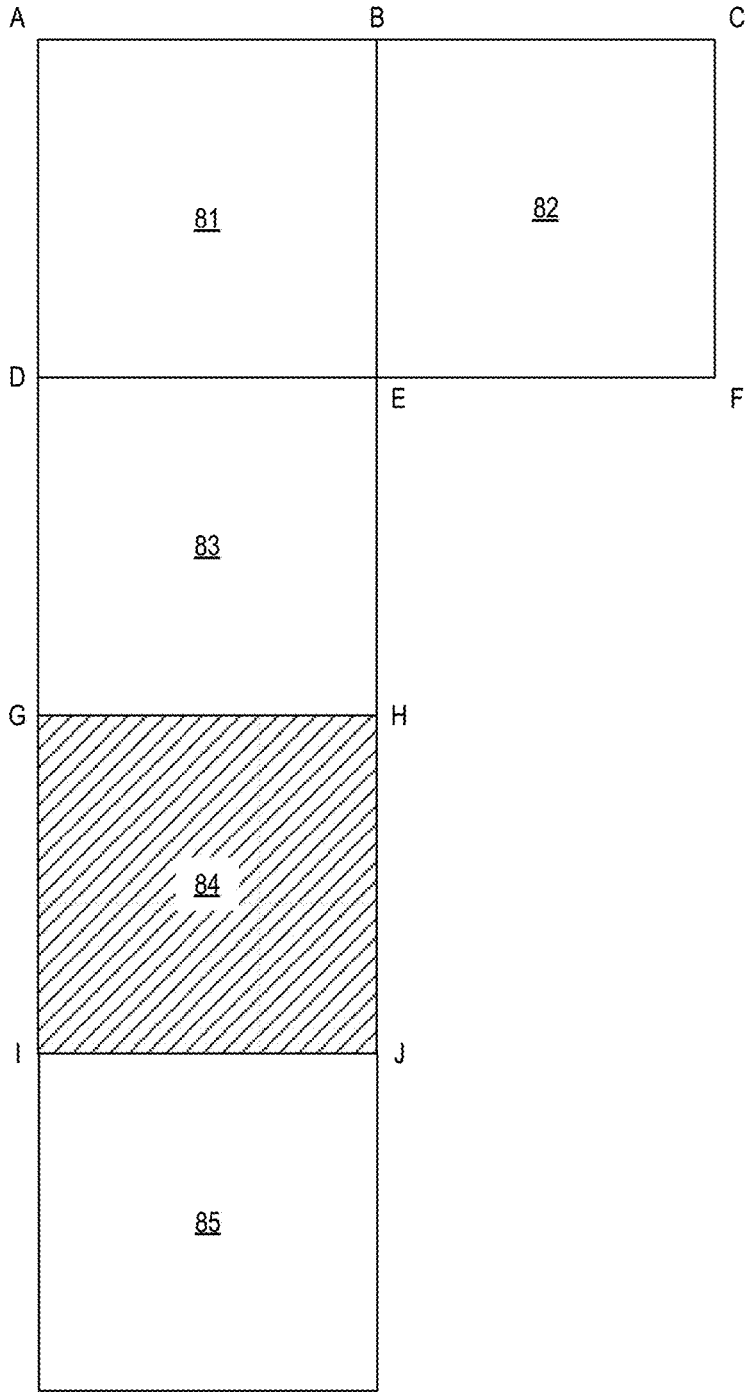
Figure 7:
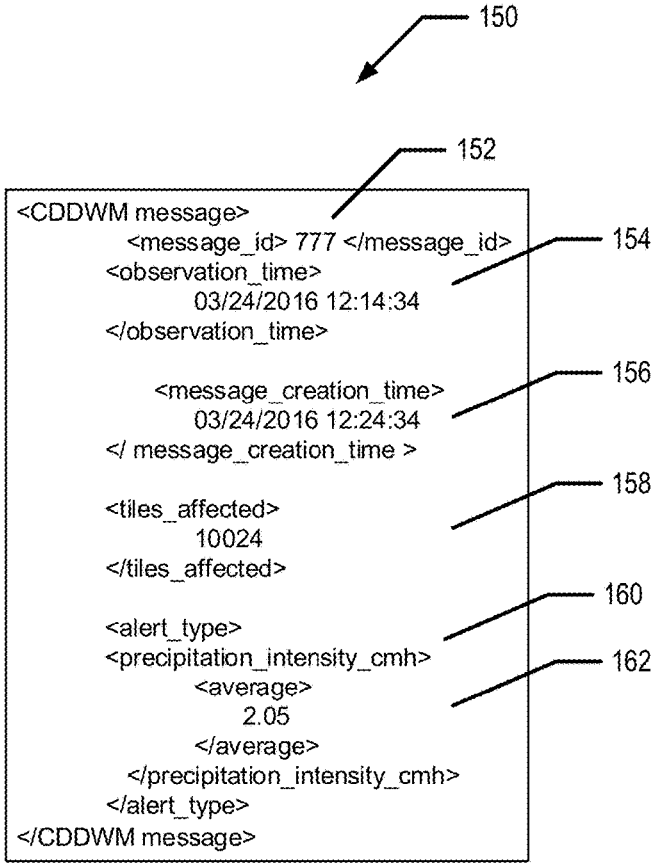

Having thus described certain example embodiments in general terms, reference will hereinafter be made to the accompanying drawings, which are not necessarily drawn to scale, and wherein:

FIG. 1 is a block diagram showing an example architecture of one embodiment of the present invention;

FIG. 1A is a block diagram showing an example architecture of another embodiment of the present invention;

FIG. 2 is a block diagram of an apparatus that may be specifically configured in accordance with an example embodiment;

FIG. 3 illustrates an example format of tile definition, in accordance with an example embodiment;

FIG. 4 is a flowchart illustrating operations performed to provide a current dangerous driving weather message, such as by the apparatus of FIG. 2, in accordance with an example embodiment;

FIG. 5 is a flowchart illustrating operations performed to provide a current dangerous driving weather message for a dangerous driving weather cluster of tiles, such as by the apparatus of FIG. 2, in accordance with an example embodiment;

FIGS. 6 and 6A each illustrate an example of a dangerous driving weather cluster, in accordance with an example embodiment; and FIGS. 7 and 8 each illustrate an example current dangerous driving weather message, in accordance with example embodiments.

DETAILED DESCRIPTION

Some embodiments will now be described more fully hereinafter with reference to the accompanying drawings, in which some, but not all, embodiments of the invention are shown. Indeed, various embodiments of the invention may be embodied in many different forms and should not be construed as limited to the embodiments set forth herein; rather, these embodiments are provided so that this disclosure will satisfy applicable legal requirements. Like reference numerals refer to like elements throughout. As used herein, the terms "data," "content," "information," and similar terms may be used interchangeably to refer to data capable of being transmitted, received and/or stored in accordance with embodiments of the present invention. Thus, use of any such terms should not be taken to limit the spirit and scope of embodiments of the present invention.

Additionally, as used herein, the term 'circuitry' refers to (a) hardware-only circuit implementations (e.g., implementations in analog circuitry and/or digital circuitry); (b) combinations of circuits and computer program product(s) comprising software and/or firmware instructions stored on one or more computer readable memories that work together to cause an apparatus to perform one or more functions described herein; and (c) circuits, such as, for example, a microprocessor(s) or a portion of a microprocessor(s), that require software or firmware for operation even if the software or firmware is not physically present. This definition of 'circuitry' applies to all uses of this term herein, including in any claims. As a further example, as used herein, the term 'circuitry' also includes an implementation comprising one or more processors and/or portion(s) thereof and accompanying software and/or firmware. As another example, the term 'circuitry' as used herein also includes, for example, a baseband integrated circuit or applications processor integrated circuit for a mobile phone or a similar integrated circuit in a server, a cellular network device, other network device, and/or other computing device.

As defined herein, a "computer-readable storage medium," which refers to a non-transitory physical storage medium (e.g., volatile or non-volatile memory device), can be differentiated from a "computer-readable transmission medium," which refers to an electromagnetic signal.

I. GENERAL OVERVIEW

Methods, apparatus and computer program products are provided in accordance with an example embodiment in order to provide dangerous driving weather (DDW) messages. The DDW message may be provided in a tile based system wherein a map and/or other representation of a geographical area is divided, segmented, and/or the like into tiles. For example, the tiling of the geographical area may comprise 1 km by 1 km square tiles, 5 km by 5 km square tiles, and/or other tilings. In general, a city or county may comprise a plurality of tiles.

In example embodiments, an apparatus may receive one or more weather reports from one or more weather stations. In example embodiments, the one or more weather reports may comprise current weather parameters and/or predicted future weather parameters. The weather parameters may be processed, analyzed, and/or the like to determine one or more current and/or predicted weather parameters and/or conditions for each tile. For example, one or more weather parameters may be analyzed, processed, and/or the like to determine a pavement condition for a tile. A DDW score for each tile may then be determined, calculated, and/or the like based on the one or more weather parameters and/or conditions. The DDW score may depend on one weather parameter/condition or a combination of two or more weather parameters and/or conditions. It may then be determined for each tile if the tile is experiencing or is expected to experience DDW conditions based on the DDW score for that tile. For example, if the DDW score for a tile is greater than a threshold value, then it may be determined that the tile is experiencing or is expected to experience DDW conditions. Current and/or expected DDW messages may be generated and provided to one or more mobile devices (e.g., user mobile devices, mobile devices, and/or the like).

As noted above, in some embodiments DDW clusters may be determined, defined, generated, and/or the like. For example, a DDW cluster may comprise two or more adjacent and/or nearby tiles that are each experiencing and/or are expected/forecasted to experience DDW. In such an embodiment, one current and/or expected DDW message may be generated that encompasses all of the tiles in the DDW cluster, rather than generating a current and/or expected DDW message for each tile of the DDW cluster.

For sake of clarity, the discussion below will focus on current DDW messages. However, it should be understood that example embodiments may generate and provide current and/or expected DDW messages based on current and/or predicted weather parameters and/or conditions.

FIG. 1 provides an illustration of an example system that can be used in conjunction with various embodiments of the present invention. As shown in FIG. 1, the system may include one or more mobile devices 20, one or more apparatuses 10, one or more weather stations 30, one or more networks 50, and/or the like. Each of the components of the system may be in electronic communication with, for example, one another over the same or different wireless or wired networks 50 including, for example, a wired or wireless Personal Area Network (PAN), Local Area Network (LAN), Metropolitan Area Network (MAN), Wide Area Network (WAN), cellular network, and/or the like. In some embodiments, a network 50 may comprise the automotive cloud, digital transportation infrastructure (DTI), radio data system (RDS)/high definition radio (HD) or other digital radio system, and/or the like. For example, a mobile device 20 and/or weather station 30 may be in communication with an apparatus 10 via the network 50. For example, the mobile device 20 may communicate with the apparatus 10 via one or more Clouds.

In example embodiments, an apparatus 10 may comprise components similar to those shown in the example apparatus 10 diagrammed in FIG. 2. For example, as shown in FIG. 2, the apparatus 10 may comprise a processor 12, memory 14, a user interface 18, a communications interface 16, and/or other components configured to perform various operations, procedures, functions or the like described herein. Example embodiments of the apparatus 10 are described in more detail below with respect to FIG. 2. In example embodiments, an apparatus 10 may responsible for providing DDW messages for the entire tiling, a region of the tiling, within a state, within a metro area, and/or the like.

In example embodiments, the mobile device 20 may comprise components similar to the apparatus 10. For example, in an example embodiment, the mobile device 20 comprises a processor, at least one memory, a user interface, a communications interface, one or more sensors (e.g., a location sensor such as a GPS sensor; windshield wiper speed sensor, camera(s); 2D and/or 3D LiDAR(s); long, medium, and/or short range RADAR; ultrasonic sensors; electromagnetic sensors; (near-)IR cameras, 3D cameras, 360° cameras, accelerometer(s), gyroscope(s), and/or other sensors that enable the mobile device to determine one or more features of the corresponding vehicle's surroundings), and/or other components configured to perform various operations, procedures, functions or the like described herein. In various embodiments, the mobile device 20 may be an in vehicle navigation system, vehicle control system, a mobile computing device, and/or the like. For example, a mobile device 20 may be an in vehicle navigation system mounted within and/or be on-board a vehicle such as a motor vehicle, non-motor vehicle, automobile, car, scooter, truck, van, bus, motorcycle, bicycle, Segway, golf cart, and/or the like. In various embodiments, the mobile device 20 may be a smartphone, tablet, personal digital assistant (PDA), and/or other mobile computing device. In another example, the mobile device 20 may be a vehicle control system configured to autonomously drive a vehicle, assist in control of a vehicle, process information/data collected, captured, gathered, or measured by one or more on-board sensors, and/or the like.

In example embodiments, a weather station 30 may comprise one or more weather sensors. For example, a weather station 30 may comprise one or more weather sensors for detecting, measuring, sensing, and/or the like one or more weather parameters. Some non-limiting examples of weather parameters are air temperature, dew point temperature, barometric pressure, visibility, humidity, precipitation intensity, and precipitation type. For example, the weather station 30 may comprise one or more weather sensors configured to detect, measure, sense, and/or the like the air temperature, dew point temperature, barometric pressure, visibility, humidity, precipitation intensity, precipitation type, and/or other weather parameter(s). Additionally, a weather station 30 may comprise one or more elements similar to the apparatus 10 and/or the mobile device 20. For example, the weather station 30 may further comprise a processor configured to receive weather parameter information/data from the one or more weather sensors, a memory, and a communications interface. In various embodiments, a weather station 30 may be a static weather station. For example, the location of the weather station 30 may be fixed and unchanging. For example, a weather station 30 may be located at an airport or other fixed location. In example embodiments, one or more weather stations 30 may be mobile. For example, the location of one or more weather stations 30 may not be fixed and may change. For example, one mobile weather station 30 may be a smart phone, a device secured to a vehicle, a temporary weather station set up for a special event, and/or the like comprising one or more weather sensors for detecting, measuring, sensing, and/or the like one or more weather parameters. In various embodiments, a weather station 30 may further comprise a location sensor (e.g., GPS sensor) for determining and/or providing weather station location information/data indicating the location of the weather station 30. In particular, mobile weather stations may comprise a location sensor. In some embodiments, the memory of a fixed weather station 30 may store weather station location information/data indicating the fixed location of the fixed weather station.

FIG. 1A provides an illustration of another example system that can be used in conjunction with various embodiments of the present invention. In the embodiment illustrated in FIG. 1A, one or more apparatus 10 communicate one or more weather stations 30 and/or one or more mobile devices 20 through a first network 52. An apparatus 10 may further communicate with one or more mobile devices 20 through a second network 54 that the apparatus 10 accesses through the first network 52. For example, the first network 52 may be the Internet, a Cloud, cellular network, Personal Area Network (PAN), Local Area Network (LAN), Metropolitan Area Network (MAN), Wide Area Network (WAN), and/or the like or a combination thereof. The second network 54 may be a proprietary network. For example, the second network 54 may be an original equipment manufacturer (OEM) Cloud. For example, the second network 54 may be an automotive cloud accessible to mobile devices 20 that are in vehicle navigation systems, vehicle control systems, and/or the like corresponding to vehicles of a particular make.

II. EXEMPLARY OPERATION

In example embodiments, one or more weather reports each comprising one or more weather parameters are regularly, periodically, and/or the like received from one or more weather stations 30. For example, weather reports may be received every five minutes, every fifteen minutes and/or the like from one or more weather stations 30. For example, each weather report may comprise one or more weather parameters that were captured, measured, and/or the like by one or more weather sensors of the weather station 30. The weather parameters may be processed and/or analyzed to determine one or more weather conditions (e.g., a pavement condition and/or the like) for each tile. For example, the weather parameters of the weather report may comprise an air temperature and a cumulative precipitation amount for the past hour, past 6 hours, past day, and/or the like. These captured weather parameters may be combined to predict and/or determine a pavement condition (e.g., dry, wet, slippery frost, packed snow, black ice, and/or the like). As used herein, a weather parameter is a weather related value that may be captured, measured, and/or the like by one or more sensors of a weather station 30 (e.g., air temperature, dew point temperature, barometric pressure, visibility, humidity, precipitation intensity, and precipitation type, and/or the like). A weather condition is determined based on processing, analyzing, and/or the like one or more weather parameters (e.g., pavement condition, and/or the like). A weather parameter may be a weather condition (e.g., air temperature and precipitation rate are a weather conditions).

In example embodiments, a DDW score may be determined for each tile. For example, based on one or more weather conditions of a tile, a DDW score for the tile may be determined. For example, the DDW score for a tile may depend on one or more of visibility, precipitation intensity, pavement condition, and/or other weather parameter and/or condition for the tile. If the DDW score is greater than a predefined threshold, a DDW message may be generated and provided. In example embodiments, DDW clusters comprising two or more tiles having a DDW score greater than a predefined threshold, or that are otherwise deemed as experiencing DDW and/or dangerous driving conditions, may be generated, created, and/or the like. In such embodiments, a DDW message for the DDW cluster may be generated and provided. Various aspects of the present invention will now be described in more detail.

A. Tiles

In example embodiments, a geographical region is represented by a web or grid comprising a plurality of tiles or web sections (the term tiles is used herein). The tiles may provide a tiling of the geographical region. For example, the tiles may be used to provide a map in a modular format (e.g., tile by tile). For example, map information/data corresponding to the geographical area may be stored, received, provided, transmitted, and/or the like in a modular format (e.g., tile by tile). In various embodiments, the tiles may be defined by a set of parallel and perpendicular tile boundaries. For example, the tiles may be rectangular or square (e.g., 1 km by 1 km squares, 2 km by 2 km squares, 5 km by 5 km squares, 10 km by 10 km squares or the like). In other embodiments, the tiles may be defined by boundaries which are curved, not parallel and/or perpendicular to one or more other boundaries, and/or the like. In various embodiments, the tiles may be a uniform tiling of the map of the geographical region. In other embodiments, the tiles may vary in size and/or shape based on the geography of the geographical region, the topology of the geographical region, population density within the geographical region, and/or the like.

In general, a city or county may be divided into, represented by, or the like a plurality of tiles. For example, the tiles are sized such that a metro area is represented by a large number of tiles. For example, in one embodiment, the Chicago metro area may be represented by 2,340 tiles. Thus, each tile corresponds to a geographical area in which weather conditions within the geographical area are generally consistent. For example, the weather conditions in one portion of the geographical area corresponding to the tile are generally not significantly different from the weather conditions in another portion of the geographical area corresponding to the tile. In example embodiments, the tiles are non-overlapping.

FIG. 3 provides an example format of a tile definition 60 for defining a tile corresponding to a geographical area. For example, a tile may be defined using a well-known text (WKT) format. In example embodiments, a tile definition 60 may comprise a header 62, a tile identifier 64, a centroid location 66, and a boundary 68. For example, the header 62 may comprise information/data necessary to interpret the tile definition 60. For example, the header 62 may indicate that the tile definition 60 comprises a tile identifier 64 and a centroid location 66 (e.g., comprising the latitude and longitude of the centroid), and indicate the format of the tile definition 60. The tile identifier 64 may be configured to uniquely identify the tile within the tiling and/or the corresponding map. The centroid location 66 may provide geospatial information/data (e.g., a latitude and/or longitude) for the geographic center, a topologically weighted geographic center, cultural center, population density center, and/or other center of the tile. The boundary 68 may indicate the boundary of the tile. For example, the boundary 68 may be provided as geospatial points corresponding to points on the surface, edges, corners, or the like of a polygon. For example, the boundary 68 may comprise the latitude and longitude for four geospatial points that comprise the four corners defining a rectangular tile. For example, the boundary 68 may be provided as a set of points, that when connected in the order provided, provide the boundary of the tile, wherein the tile is defined as the area or region enclosed by the boundary.

B. Providing a Dangerous Driving Weather Message

Example embodiments of the present invention provide one or more current DDW messages (and/or expected/ anticipated/forecasted DDW messages). FIG. 4 illustrates a flowchart of various operations that may be performed in example embodiments to provide a DDW message.

Starting at block 102, one or more weather reports may be received. For example, the apparatus 10 may receive one or more weather reports. For example, the apparatus 10 may comprise means, such as processor 12, communications interface 16, and/or the like, for receiving one or more weather reports. For example, the one or more weather stations 30 may each provide and/or transmit a weather report. The weather reports may then be received by the apparatus 10. In example embodiments, the one or more weather reports may be received regularly, periodically, and/or the like (e.g., every fifteen minutes). In example embodiments, each weather report may comprise weather information/data indicating a measurement for at least one weather parameter, a time stamp, a weather station identifier, station location information/data indicating the physical location of the weather station at the time the measurement of the at least one weather parameter was captured, and/or the like. For example, a weather report may indicate that weather station KORD is located at 41.9786° N, 87.9047° W and at 1:04 pm CST on Jul. 7, 2016 captured weather parameter measurements indicating that the air temperature is 83.7° F., the dew point temperature is 68° F., current precipitation intensity is 0 inches per hour, current wind speed is 4 mph from the east-northeast, and/or the like. In various embodiments, a weather report may include measurements of current weather parameters (e.g., current when the measurement was captured) and/or include forecasted weather parameters. Some non-limiting examples of weather parameters are air temperature, dew point temperature, barometric pressure, visibility, humidity, precipitation intensity, and precipitation type. For example, a weather station 30 may comprise one or more sensors configured to detect, measure, sense, and/or the like the air temperature, dew point temperature, barometric pressure, visibility, humidity, precipitation intensity, precipitation type, and/or other weather parameter(s).

At block 104, the DDW score for one or more tiles may be determined. For example, the apparatus 10 may determine a DDW score for each tile. For example, the apparatus 10 may comprise means, such as processor 12 and/or the like, for determining a DDW score for each tile. In example embodiments, a DDW score for a tile may be determined based on one or more weather conditions. In example embodiments, there may not be a weather station 30 located within each tile. In such embodiments, the weather conditions for each tile may be determined by various methods. For example, the weather conditions for each tile may be determined as described in U.S. application Ser. No. 15/077,507 filed Mar. 22, 2016, which is hereby incorporated by reference herein in its entirety. In an example embodiment, a DDW score for a tile may be determined based on a combination of visibility, precipitation intensity, and pavement conditions. In another example embodiment, a DDW score for a tile may be determined based on one of visibility, precipitation intensity and pavement conditions. In example embodiments, a variety of weather conditions may be used to determine a DDW score alone or in combination.

In an example embodiment, a DDW score for a tile may be determined by computing (W1*1/V+W2*I+W3*P)/(W1+W2+W3), wherein V is the visibility, I is the precipitation intensity, P is a pavement condition indicator, and W1, W2, and W3 are weights for the visibility, precipitation intensity, and pavement condition, respectively. In this example embodiment, the value of the reciprocal of the visibility (1/V) is used, as the lower the visibility the more dangerous the driving conditions. In an example embodiment, the pavement condition may be assigned a numerical pavement condition indicator based on the pavement conditions and/or expected pavement conditions. For example, the pavement condition indicator may be assigned the value of 3 for a black ice pavement condition, 2 for a slippery frost pavement condition, 1 for a packed snow pavement condition, and 0 for other, less dangerous pavement conditions. In another example, the pavement condition indicator may be assigned the value of 4 for a black ice pavement condition, 3 for a slippery frost pavement condition, 2 for a packed snow pavement condition, 1 for a wet pavement condition, and 0 for a dry pavement condition.

In example embodiments, the weights W1, W2, and W3 may be determined based on what is considered an acceptable value for each of the weather conditions used to determine the DDW score for a tile. For example, it may be determined that if the visibility is below 3 kilometers, the driving conditions are dangerous. Thus, W1 may be selected such that W1*1/V (or W1/3) is equal to or greater than a score threshold value. If the score threshold value is 2, then W1 may be selected to be 6, for example. In example embodiments, tiles having a DDW score less than the score threshold value may be determined to not be experiencing dangerous enough driving weather conditions to warrant a DDW message. Similarly, tiles having DDW scores greater than or equal to the score threshold value may be determined to be experiencing DDW, as discussed below.

At block 106, tiles experiencing DDW are identified (or expected/anticipated/forecasted to experience DDW in the near future). For example, the apparatus 10 may identify tiles in which DDW is being experienced. For example, the apparatus 10 may comprise means, such as processor 12 and/or the like for identifying tiles in which DDW is being experienced. In example embodiments, the identification of tiles in which DDW is being experienced is based at least in part on the DDW score for the tile. For example, if a first weather condition for a tile has a value that is greater than the score threshold value for the first weather condition, the tile may be identified experiencing DDW. For example, the precipitation rate for the first tile is greater than 1.75 centimeters per hour and the score threshold value for precipitation rate is 1.7 centimeters per hour, the first tile may be identified as experiencing DDW. In another example, if a particular combination of weather conditions for a first tile are greater than the score threshold value for the particular combination of weather conditions, the first tile may be identified as experiencing DDW. For example, a particular combination of precipitation rate, the reciprocal of the visibility, and a numerical indication of the pavement condition for a tile may be greater than the score threshold value for the particular combination, indicating the tile is experiencing DDW. For example, if the precipitation rate is 1 cm per hour, the visibility is 5 km for a tile, it may be determined that DDW is being experienced within that tile. If it is determined that one or more weather conditions indicate that a tile is currently experiencing DDW, a current DDW message for the tile may be triggered. For example, identification of a tile that is experiencing DDW may trigger a DDW message to be generated for the identified tile.

In an example embodiment, once a first tile has been identified as experiencing DDW, a weather reports pertaining to the first tile may be requested and/or received from one or more weather stations 30 on a shorter time frame than weather reports pertaining to a second tile that has not been identified as experiencing DDW. For example, weather reports may be requested and/or received from weather stations 30 located within the first tile and/or within the vicinity of the first tile more frequently than before the first tile was identified as experiencing DDW. For example, a weather report relating to a first tile may be received every fifteen minutes. After determining the first tile is experiencing DDW, a weather report relating to the first tile may be received every five minutes. Once the DDW experienced by the first tile has dissipated and/or moved on, a weather report relating to the first tile may again be received every fifteen minutes. In an example embodiment, DDW experienced by a first tile may be determined to have dissipated and/or moved on after a predetermined number of DDW scores for the first tile indicate that the tile is no longer experiencing DDW, if a predetermined time period (that is greater than the time period between receiving weather reports for the first tile) elapses since the first tile was last identified as experiencing DDW, and/or the like.

At block 108, one or more DDW messages are generated. For example, the apparatus 10 may generate a DDW messages for each tile that was identified as experiencing DDW. For example, the apparatus 10 may comprise means, such as the processor 12 and/or the like, for generating DDW messages for tiles identified as experiencing DDW. In example embodiments, the DDW message may comprise a tile identifier 64 identifying the tile the DDW message pertains to. The DDW message may further comprise alert information indicating what form(s) of DDW is being experienced within the tile. A DDW message may comprise a variety of other relevant information/data as appropriate for the application. In an example embodiment, a DDW message may include a time stamp indicating when the DDW message was generated, when the weather report that triggered the DDW message was received, when the weather parameters provided in the weather report that triggered the DDW message were captured, and/or the like. Example formats for a current DDW message are provided by FIGS. 7 and 8 and discussed in more detail elsewhere herein.

In example embodiments, the DDW message may expire after a predetermined amount of time has passed since the DDW message was generated. In another example embodiment, the DDW message may expire after a predetermined amount of time has elapsed with respect to a time stamp of the DDW message. In example embodiments, a first DDW message corresponding to a first tile may be replaced by or cancelled in favor of a second DDW message having a later time stamp and corresponding to the first tile. In example embodiments, the predetermined amount of time that elapses may be based at least in part on the type of DDW being experienced within the tile. For example, the predetermined amount of time for tiles experiencing black ice pavement conditions may be different from the predetermined amount of time for tiles experiencing poor visibility.

At block 110, the one or more DDW messages are provided. For example, the apparatus 10 may provide one or more DDW messages. For example, the apparatus 10 may comprise means, such as processor 12, communications interface 16, and/or the like, for providing one or more DDW messages. In an example embodiment, the one or more DDW messages are provided in an order of largest DDW score to smallest DDW score. In example embodiments, the apparatus 10 provides one or more DDW messages directly to one or more mobile devices 20, for example, through network 50. For example, the apparatus 10 may transmit a DDW message for a first tile to one or more mobile devices 20 currently located within the first tile or expected to be in or traveling through the first tile in the near future (e.g., before the DDW message expires). For example, the apparatus 10 may receive location information indicating the current physical location of a mobile device 20 and/or an expected route of a mobile device 20 and provide a DDW message to appropriate mobile devices 20 based thereon. In some example embodiments, the apparatus 10 may provide one or more DDW messages to a second network 54 through a first network 52. The one or more DDW messages may then be provided to one or more mobile devices 20 through the second network 54. The second network 54 may be configured to receive current physical location and/or route information/data for one or more mobile devices 20 and provide a DDW message to a mobile device 20 based thereon. For example, if a mobile device 20 is currently located within a tile corresponding to a DDW message, or expected to be within a tile corresponding to the DDW message before the DDW message expires, the second network 54 may provide the DDW message to the mobile device 20. In example embodiments, the second network 54 may be an original equipment manufacturer network configured to communicate with mobile devices 20 associated with the operator of the second network. For example, the second network 54 may be an automotive cloud network operated by BMW and configured to communicate with mobile devices 20 corresponding to BMW vehicles.

After receiving one or more DDW messages, a mobile device 20 may provide an indication, warning, alert, and/or the like of the DDW being experienced in the corresponding tile. For example, a user interface of the mobile device 20 may provide information, a warning, alert, and/or the like of the DDW condition indicated by the DDW message. In an example embodiment, the mobile device 20 may cause one or more vehicle systems parameters to be modified in response to the DDW message (e.g., four wheel drive may be activated in response to receiving a DDW message indicating black ice pavement conditions).

C. Reducing the Number of DDW Messages

In example embodiments, a DDW message is generated and provided for each tile experiencing DDW. As indicated above, a tile used by the present invention is generally smaller (and may be significantly smaller) than a city or county. For example, the Chicago metro area may be represented by 2,340 tiles in an example embodiment. Thus, if one or more storms are causing DDW conditions, then a large number of DDW messages may be generated and/or provided. In some situations, the number of DDW messages generated and/or provided may be prohibitively large. FIG. 5 provides a flowchart illustrating various processes that may be used to reduce the number of DDW messages generated and/or provided.

One or more weather reports may be received, as described above with respect to block 102. The DDW score for one or more tiles (e.g., for each tile) may be determined and/or calculated based on one or more weather conditions corresponding to the tile, as described above with respect to block 104. At block 202, a first tile experiencing DDW is identified. For example, a first tile may be identified as experiencing DDW as described with respect to block 106. For example, the first tile may be identified as experiencing DDW based on the DDW score determined, calculated, and/or the like for the first tile. For example, the apparatus 10 may identify a first tile as experiencing DDW. For example, the apparatus 10 may comprise means, such as the processor 12 and/or the like, for identifying a first tile experiencing DDW.

At block 204, it may be determined if any of the tiles adjacent the first tile are experiencing DDW. For example, the apparatus 10 may determine if any of the tiles adjacent the first tile are experiencing DDW. For example, the apparatus 10 may comprise means, such as the processor 12 and/or the like, for determining if any of the tiles adjacent the first tile are experiencing DDW. For example, a process similar to that described with reference to block 106 may be used to determine if any of the tiles adjacent the first tile are experiencing DDW. For example, it may be determined if the DDW score for a tile adjacent the first tile is greater than and/or greater than or equal to a score threshold value. For example, if the tiles are defined by a square or rectangular grid, it may be determined if either of the blocks on the same row of the grid and directly adjacent to the first tile are experiencing DDW and then it may be determined if either of the blocks on the same column of the grid and directly adjacent to the first tile are experiencing DDW. For example, it may be determined if any tiles that share a boundary edge with the first tile are experiencing DDW.

If, at block 204, it is determined that none of the tiles adjacent the first tile are experiencing DDW, the process continues to block 206. At block 206, a DDW message is generated for the first tile, similar to as described with respect to block 108. The DDW message for the first tile may then be provided in a manner similar to that described above with respect to block 110. For example, the apparatus 10 may generate and/or provide a DDW message for the first tile. For example, the apparatus 10 may comprise means, such as the processor 12, communications interface 16, and/or the like, for generating and/or providing a DDW message for the first tile.

If, at block 204, it is determined that at least one of the tiles adjacent the first tile are experiencing DDW, the process continues to block 208. At block 208, a DDW cluster is generated, defined, created, and/or the like. For example, a DDW cluster may be generated, defined, created, and/or the like that comprises the first tile and the one or more tiles adjacent the first tile identified as experiencing DDW. For example, the apparatus 10 may generate, define, create, and/or the like a DDW cluster comprising the first tile and one or more tiles adjacent the first tile that were identified at block 204 as experiencing DDW. For example, the apparatus 10 may comprise means, such as the processor 12 and/or the like, for generating, defining, creating, and/or the like a DDW cluster comprising the first tile and one or more tiles adjacent the first tile that were identified at block 204 as experiencing DDW.

At block 210, it is determined if any tiles adjacent to the DDW cluster, but not already in the DDW cluster, are experiencing DDW. For example, the apparatus 10 may determine if any of the tiles adjacent DDW cluster are experiencing DDW. For example, the apparatus 10 may comprise means, such as the processor 12 and/or the like, for determining if any of the tiles adjacent the DDW cluster are experiencing DDW. For example, a process similar to that described with reference to block 106 may be used to determine if any of the tiles adjacent the DDW cluster are experiencing DDW. For example, it may be determined if the DDW score for a tile adjacent the DDW cluster is greater than and/or greater than or equal to a score threshold value. For example, if the tiles are defined by a square or rectangular grid, it may be determined if either of the tiles on the same row of the grid and directly adjacent to the first tile are experiencing DDW and then it may be determined if either of the tiles on the same column of the grid and directly adjacent to the first tile are experiencing DDW. For example, it may be determined if any tiles that share a boundary edge with at least one of the tiles in the DDW cluster are experiencing DDW. For example, it may be determined if any of the tiles that have a boundary that at least in part matches the boundary of the DDW cluster is experiencing DDW. For example, the boundary of the DDW cluster may be determined by directionally adding the boundaries of the tiles comprising the DDW cluster.

FIG. 6 illustrates an example DDW cluster comprising first tile 81, second tile 82, and third tile 83. The boundary of the first tile 81 is the polygon A to B, B to E, E to D, and D to A, as indicated by the empty arrows. The boundary of the second tile 82 is the polygon B to C, C to F, F to E, and E to B, as indicated by the arrows having diagonal lines therein. The boundary of the third tile 83 is the polygon E to H, H to G, G to D, and D to E, as indicated by the dotted arrows. When the boundaries of the first tile 81, second tile 82, and third tile 83 are directionally added, the boundary of first tile 81 from E to D and the boundary of third tile 83 from D to E cancel each other out. Thus, the line between point D and point E is not a part of the boundary of the DDW cluster. Similarly, the boundary of first tile 81 from B to E and the boundary of the second tile 82 from E to B, when directionally added to determine the DDW cluster boundary, cancel out. Thus, the boundary of the example illustrated DDW cluster is A to C, C to F, F to E, E to H, H to G, and G to A. A tile is considered adjacent to the DDW cluster if a portion of the boundary of the DDW cluster is a boundary of the tile. For example, a tile having the line segment D to G as a part of its boundary is adjacent to the example illustrated DDW cluster.

Returning to FIG. 5, if, at block 210, it is determined that there are one or more tiles adjacent the DDW cluster that are experiencing DDW, the process continues to block 212. At block 212, the one or more tiles adjacent the DDW cluster that were identified as experiencing DDW are added to the DDW cluster. For example, the apparatus 10 may add the one or more tiles adjacent the DDW cluster that were identified as experiencing DDW to the DDW cluster. For example, the apparatus 10 may comprise means, such as processor 12 and/or the like, for adding the one or more tiles adjacent the DDW cluster that were identified as experiencing DDW to the DDW cluster. For example, if it is determined that a fourth tile that is adjacent the example DDW cluster shown in FIG. 6 is experiencing dangerous driving conditions, the fourth tile is added to the DDW cluster such that the DDW cluster now comprises the first tile 81, the second tile 82, the third tile 83, and the fourth tile. The process then returns to block 210 to determine if any tiles adjacent the expanded DDW cluster are experiencing DDW.

If, at block 210, it is determined that there are no tiles adjacent the DDW cluster that are experiencing DDW, the process continues to block 214. At block 214 it is determined if any nearby tiles are experiencing DDW. In this context, a nearby tile is defined as a tile that shares a boundary with another tile that is not in the DDW cluster but that shares a boundary with the cluster. For example, FIG. 6A shows a cluster comprising a first tile 81, a second tile 82, and a third tile 83. A fourth tile 84, shares the boundary GH with the third tile 83. However, the fourth tile 84 is not experiencing DDW (e.g., the DDW score for the fourth tile is below the corresponding score threshold value) and therefore is not in the cluster comprising the first tile 81, the second tile 82, and the third tile 83. A fifth tile 85 shares the boundary IJ with the fourth tile 84. Thus, the fifth tile 85 is a nearby tile with respect to the DDW cluster comprising the first tile 81, the second tile 82, and the third tile 83. The apparatus 10 may determine if any nearby tiles with respect to the DDW cluster are experiencing DDW. For example, the apparatus 10 may comprise means, such as processor 12 and/or the like, for determining if any tiles nearby the DDW cluster are experiencing DDW. For example, it may be determined that the fifth tile 85 is experiencing DDW (e.g., the DDW score for the fifth tile 85 is greater than or equal to the corresponding score threshold value). For example, a process similar to that described with reference to block 106 may be used to determine if any of the nearby tiles are experiencing DDW.

Returning to FIG. 5, if, at block 214, it is determined that there are one or more tiles nearby the DDW cluster, that are experiencing DDW, the process continues to block 216. At block 216, the one or more tiles nearby the DDW cluster, that are experiencing DDW are added to the DDW cluster. For example, the apparatus 10 may add the one or more tiles nearby the DDW cluster that are experiencing DDW to the cluster. For example, the apparatus 10 may comprise means, such as the processor 12 and/or the like, for adding the one or more nearby tiles that are experiencing DDW to the cluster. For example, the DDW cluster shown in FIG. 6A now comprises the first tile 81, the second tile 82, the third tile 83, and the fifth tile 85. In some example embodiments, the nearby tile(s) experiencing DDW and the adjoining tile(s) not experiencing DDW are added to the DDW cluster. In the present application an adjoining tile is a tile that shares a boundary with the DDW cluster and another boundary with a tile that is nearby the DDW cluster but not adjacent the DDW cluster. For example, in FIG. 6A, the fourth tile 84 is an adjoining tile. For example, the DDW cluster shown in the illustrated example of FIG. 6A would comprise the first tile 81, the second tile 82, the third tile 82, the fourth tile 84, and the fifth tile 85, since the fourth tile 84 connects the fifth tile 85 to the DDW cluster. The process may then return to block 210 to determine if there are any tiles adjacent the DDW cluster that are experiencing DDW.

If, at block 214, it is determined that there are not any nearby tiles that are experiencing DDW, the process may continue to block 218. At block 218, a DDW message for the DDW cluster is generated and/or provided. For example, the apparatus 10 may generate and/or provide a DDW message for the DDW cluster. For example, the apparatus 10 may comprise means, such as the processor 12, communications interface 16, and/or the like, for generating and/or providing a DDW message for the DDW cluster. For example, the DDW message may be generated and/or provided similar to as described above with respect to blocks 108, 110, and/or 206. In particular, the DDW message may comprise one or more tile identifiers configured to each identify one of the tiles of the DDW cluster. In example embodiments, the DDW message comprises a tile identifier for each tile of the DDW cluster. In an example embodiment, a cluster score is determined for the DDW cluster. For example, the cluster score may be the average (e.g., mean, median, or mode) of the DDW score for each tile in the cluster or may be the maximum DDW score for tiles in the DDW cluster. In an example embodiment, the cluster score may be used to determine the order in which DDW messages are provided. For example, the DDW messages may be provided in an order where the DDW messages corresponding to tiles or DDW clusters having higher scores (e.g., DDW score or cluster score) are provided before DDW messages corresponding to tiles or DDW clusters having lower scores. For example, the higher the DDW score or cluster score corresponding to the DDW message, the higher the urgency with which the DDW message may be provided. After generating and/or providing the DDW message for the DDW cluster, the process may return to block 102 to await the next weather report(s) or return to block 202 to (attempt to) identify further tiles experiencing DDW.

D. Exemplary Formats of a Current Dangerous Driving Weather Message

Example embodiments of the present invention provide a universal format for current DDW message. A similar format may be used for universal future, expected, and/or predicted DDW messages. While a DDW message may be provided in a number of formats, a universal format allows for the easiest interpretation and processing of the DDW message by a wide range of mobile devices 20. In example embodiment, the DDW message may be in an XML format or other computer-readable format.

FIG. 7 illustrates an example DDW message 150 of the universal format that relates to one tile and was triggered by one weather parameter and/or condition. FIG. 8 illustrates an example DDW message 150' of the universal format that relates to a DDW cluster and was trigger by multiple weather parameters and/or conditions. The example DDW messages 150, 150' each comprise a message identifier 152, 152'; an observation time 154, 154'; a message creation time 156, 156'; an affected tile identifier list 158, 158'; at least one alert type 160, 160*a*', 160*b*', 160*c*'; and alert information/data 162, 162*a*', 162*b*', 162*c*'. In example embodiments, the message identifier 152, 152' is configured to uniquely identify the DDW message 150, 150'.

The observation time 154, 154' may indicate the time that the DDW condition was observed. For example, the observation time 154, 154' may indicate the time at which one or more weather parameters that triggered the DDW message 150, 150' were captured, sensed, measured, and/or the like. For example, the observation time 154, 154' may indicate the time at which one or more weather parameters that were used to identify that a tile is experiencing DDW were captured sensed, measured, and/or the like. In another example, the observation time 154, 154' may indicate the time at which a weather report comprising one or more weather parameters that caused the triggering of the DDW message 150, 150' was generated, transmitted, or received by the apparatus 10. In example embodiments, the observation time 154, 154' is in coordinated universal time (UTC). In example embodiments, the message creation time 156, 156' may be configured to indicate the time the DDW message 150, 150' was generated. In example embodiments, the message creation time 156, 156' may be in UTC. In example embodiments, an expiration time of the DDW message 150, 150' may be based on the observation time 154, 154' or the message creation time 156, 156', as appropriate for the application.

The DDW message 150, 150' further comprises an affected tile identifier list 158, 158'. The affected tile identifier list 158, 158' comprises one or more tile identifiers 64 that identify the tiles identified as being affected by the DDW and to which the DDW message pertains. For example, the affected tile identifier list 158, 158' may comprise one or more tile identifiers 64 that identify the one or more tiles affected by the DDW that the DDW message 150, 150' reports, provides a warning or alert regarding, and/or the like. In example embodiments, the affected tile identifier list 158' comprises the tile identifier 64 of the tiles in the DDW cluster to which the DDW message pertains. In example embodiments, the affected tile identifier list 158, 158' may be used to determine which mobile devices 20 the DDW message 150, 150' should be provided to. For example, if the apparatus 10, or a component of the second network 54, and/or the like determines that a mobile device 20 is located within a tile identified by a tile identifier 64 listed in the affected tile identifier list 158, 158' or expected to be located within a tile identified by a tile identifier 64 listed in the affected tile identifier list 158, 158' before the expiration of the DDW message 150, 150', the mobile device 20 may be provided with the DDW message 150, 150'. For example, the apparatus 10, a component of the second network 54, and/or the like may store a mapping from a tile identifier 64 to the area or region represented by and/or corresponding to the tile (e.g., based on the tile definition 60 and/or the like).

The DDW messages 150, 150' further comprise one or more alert types 160, 160*a*', 160*b*', 160*c*'. The alert type may be configured to indicate what type of DDW is being experienced in the affected tiles to which the DDW message 150, 150' pertains. For example, the alert type 160 for DDW message 150 is precipitation intensity. For example, the precipitation intensity is the weather parameter and/or condition that triggered the DDW message 150' and/or caused the tile identified by the affected tile identifier 158 to be identified as a tile experiencing DDW. The DDW message 150' comprises three alert types 160*a*', 160*b*', 160*c*'. For example, the DDW message 150' may have been triggered by a combination of three different weather conditions. For example, the DDW message 150' may have been triggered by a combination of the precipitation intensity, visibility, and pavement condition in the affected tiles.

Alert information/data 162, 162*a*', 162*b*', 162*c*' may be further provided by the DDW message 150, 150'. For example, the alert information/data 162 indicates that the average measured precipitation intensity in the tile identified by the affected tile identifier 158 was 2.05 centimeters per hour. In example embodiments, alert information/data 162, 162*a*', 162*b*', 162*c*' may be provided for each alert type 160, 160*a*', 160*b*', 160*c*'. For example, DDW message 150' indicates that the average precipitation intensity experienced within the tiles of the DDW cluster is 2.05 centimeters per hour and the standard deviation of the precipitation intensity among the tiles of the DDW cluster is 0.05 centimeters per hour. In another example, the DDW message 150' may indicate that the average visibility experienced within the tiles of the DDW cluster is 1.65 kilometers and the standard deviation of the visibility among the tiles of the DDW cluster is 0.135 kilometers. In yet another example, the DDW message 150' may indicate that a slipper frost pavement condition is being experienced in at least one tile of the DDW cluster.

In an example embodiment, in response to receiving a DDW message, the mobile device 20 may provide a notification (e.g., visual, audible, or other notification or alert) through a use interface of the mobile device 20 indicating the alert type 160 and/or at least a portion of the alert information/data 162. For example, the mobile device 20 may provide an alert through a user interface thereof warning a user of heavy precipitation in the area. In another example, the mobile device 20 may cause one or more changes to the vehicle systems parameters based on the DDW message 150 (e.g., a vehicle with four wheel drive capabilities may automatically activate the four wheel drive feature when the pavement condition is reported as "black ice" and/or the like).

III. EXAMPLE APPARATUS

The mobile device 20 and/or apparatus 10 of an example embodiment may be embodied by or associated with a variety of computing devices including, for example, such as a navigation system including an in-vehicle navigation system, a vehicle control system, a personal navigation device (PND) or a portable navigation device, an advanced driver assistance system (ADAS), a global positioning system (GPS), a cellular telephone, a mobile phone, a personal digital assistant (PDA), a watch, a camera, a computer, and/or other device that can perform navigation-related functions, such as digital routing and map display. Additionally or alternatively, the apparatus 10 may be embodied in other types of computing devices, such as a server, a personal computer, a computer workstation, a laptop computer, a plurality of networked computing devices or the like, that are configured to identify one or more tiles experiencing or expected/forecasted to experience DDW conditions, generate one or more DDW messages pertaining to the identified tile(s), and provide the one or more DDW messages. In this regard, FIG. 2 depicts an apparatus 10 of an example embodiment that may be embodied by various computing devices including those identified above. As shown, the apparatus 10 of an example embodiment may include, may be associated with or may otherwise be in communication with a processor 12 and a memory device 14 and optionally a communication interface 16 and/or a user interface 18. Similarly, a mobile device 20 of an example embodiment may include, may be associated with, or may otherwise be in communication with a processor, and a memory device, a communication interface, a user interface, and/or one or more sensors (e.g., a location sensor such as a GPS sensor; camera(s); 2D and/or 3D LiDAR(s); long, medium, and/or short range RADAR; ultrasonic sensors; electromagnetic sensors; (near-)IR cameras, 3D cameras, 360° cameras, accelerometer(s), gyroscope(s), and/or other sensors that enable the mobile device to determine one or more features of the corresponding vehicle's surroundings).

In some embodiments, the processor 12 (and/or co-processors or any other processing circuitry assisting or otherwise associated with the processor) may be in communication with the memory device 14 via a bus for passing information among components of the apparatus. The memory device may be non-transitory and may include, for example, one or more volatile and/or non-volatile memories. In other words, for example, the memory device may be an electronic storage device (e.g., a computer readable storage medium) comprising gates configured to store data (e.g., bits) that may be retrievable by a machine (e.g., a computing device like the processor). The memory device may be configured to store information, data, content, applications, instructions, or the like for enabling the apparatus to carry out various functions in accordance with an example embodiment of the present invention. For example, the memory device could be configured to buffer input data for processing by the processor. Additionally or alternatively, the memory device could be configured to store instructions for execution by the processor.

As described above, the apparatus 10 and/or mobile device 20 may be embodied by a computing device. However, in some embodiments, the apparatus may be embodied as a chip or chip set. In other words, the apparatus may comprise one or more physical packages (e.g., chips) including materials, components and/or wires on a structural assembly (e.g., a baseboard). The structural assembly may provide physical strength, conservation of size, and/or limitation of electrical interaction for component circuitry included thereon. The apparatus may therefore, in some cases, be configured to implement an embodiment of the present invention on a single chip or as a single "system on a chip." As such, in some cases, a chip or chipset may constitute means for performing one or more operations for providing the functionalities described herein.

The processor 12 may be embodied in a number of different ways. For example, the processor may be embodied as one or more of various hardware processing means such as a coprocessor, a microprocessor, a controller, a digital signal processor (DSP), a processing element with or without an accompanying DSP, or various other processing circuitry including integrated circuits such as, for example, an ASIC (application specific integrated circuit), an FPGA (field programmable gate array), a microcontroller unit (MCU), a hardware accelerator, a special-purpose computer chip, or the like. As such, in some embodiments, the processor may include one or more processing cores configured to perform independently. A multi-core processor may enable multiprocessing within a single physical package. Additionally or alternatively, the processor may include one or more processors configured in tandem via the bus to enable independent execution of instructions, pipelining and/or multithreading.

In an example embodiment, the processor 12 may be configured to execute instructions stored in the memory device 14 or otherwise accessible to the processor. Alternatively or additionally, the processor may be configured to execute hard coded functionality. As such, whether configured by hardware or software methods, or by a combination thereof, the processor may represent an entity (e.g., physically embodied in circuitry) capable of performing operations according to an embodiment of the present invention while configured accordingly. Thus, for example, when the processor is embodied as an ASIC, FPGA or the like, the processor may be specifically configured hardware for conducting the operations described herein. Alternatively, as another example, when the processor is embodied as an executor of software instructions, the instructions may specifically configure the processor to perform the algorithms and/or operations described herein when the instructions are executed. However, in some cases, the processor may be a processor of a specific device (e.g., a pass-through display or a mobile terminal) configured to employ an embodiment of the present invention by further configuration of the processor by instructions for performing the algorithms and/or operations described herein. The processor may include, among other things, a clock, an arithmetic logic unit (ALU) and logic gates configured to support operation of the processor.

In some embodiments, the apparatus 10 may include a user interface 18 that may, in turn, be in communication with the processor 12 to provide output to the user, such as a proposed route, and, in some embodiments, to receive an indication of a user input. As such, the user interface may include a display and, in some embodiments, may also include a keyboard, a mouse, a joystick, a touch screen, touch areas, soft keys, a microphone, a speaker, or other input/output mechanisms. Alternatively or additionally, the processor may comprise user interface circuitry configured to control at least some functions of one or more user interface elements such as a display and, in some embodiments, a speaker, ringer, microphone and/or the like. The processor and/or user interface circuitry comprising the processor may be configured to control one or more functions of one or more user interface elements through computer program instructions (e.g., software and/or firmware) stored on a memory accessible to the processor (e.g., memory device 14, 24, and/or the like).

The apparatus 10 may include a communication interface 16. The communication interface may be any means such as a device or circuitry embodied in either hardware or a combination of hardware and software that is configured to receive and/or transmit data from/to a network and/or any other device or module in communication with the apparatus. In this regard, the communication interface may include, for example, an antenna (or multiple antennas) and supporting hardware and/or software for enabling communications with a wireless communication network. Additionally or alternatively, the communication interface may include the circuitry for interacting with the antenna(s) to cause transmission of signals via the antenna(s) or to handle receipt of signals received via the antenna(s). In some environments, the communication interface may alternatively or also support wired communication. As such, for example, the communication interface may include a communication modem and/or other hardware/software for supporting communication via cable, digital subscriber line (DSL), universal serial bus (USB) or other mechanisms.

In addition to embodying the apparatus 10 and/or mobile device 20 of an example embodiment, a navigation system may also include or have access to a geographic database that includes a variety of data (e.g., map information/data) utilized in constructing a route or navigation path and determining the time to traverse the route or navigation path. For example, a geographic database may include node data records (e.g., including anchor node data records comprising junction identifiers), road segment or link data records, point of interest (POI) data records and other data records. More, fewer or different data records can be provided. In one embodiment, the other data records include cartographic ("carto") data records, routing data, and maneuver data. One or more portions, components, areas, layers, features, text, and/or symbols of the POI or event data can be stored in, linked to, and/or associated with one or more of these data records. For example, one or more portions of the POI, event data, or recorded route information can be matched with respective map or geographic records via position or GPS data associations (such as using known or future map matching or geo-coding techniques), for example. In example embodiments, the apparatus 10 may be configured to modify, update, and/or the like one or more data records of the geographic database. As should be understood, the map information/data may relate to various modes of transportation (e.g., automobile, public transportation, bus, train, biking, running, walking, etc.) and navigation around various geographic areas (e.g., indoors such as in a mall, in a bounded indoor/outdoor area such as an amusement park, in a generally unbounded outdoor area such as for roadway travel, and/or the like).

In an example embodiment, the road segment data records are links or segments, e.g., maneuvers of a maneuver graph, representing roads, streets, or paths, as can be used in the calculated route or recorded route information for determination of one or more personalized routes. The node data records are end points corresponding to the respective links or segments of the road segment data records. The road link data records and the node data records represent a road network, such as used by vehicles, cars, and/or other entities. Alternatively, the geographic database can contain path segment and node data records or other data that represent pedestrian paths or areas in addition to or instead of the vehicle road record data, for example.

The road/link segments and nodes can be associated with attributes, such as geographic coordinates, street names, address ranges, speed limits, turn restrictions at intersections, and other navigation related attributes, as well as POIs, such as gasoline stations, hotels, restaurants, museums, stadiums, offices, automobile dealerships, auto repair shops, buildings, stores, parks, etc. The geographic database can include data about the POIs and their respective locations in the POI data records. The geographic database can also include data about places, such as cities, towns, or other communities, and other geographic features, such as bodies of water, mountain ranges, etc. Such place or feature data can be part of the POI data or can be associated with POIs or POI data records (such as a data point used for displaying or representing a position of a city). In addition, the geographic database can include and/or be associated with event data (e.g., traffic incidents, constructions, scheduled events, unscheduled events, etc.) associated with the POI data records or other records of the geographic database.

The geographic database can be maintained by the content provider (e.g., a map developer) in association with the services platform. By way of example, the map developer can collect geographic data to generate and enhance the geographic database. There can be different ways used by the map developer to collect data. These ways can include obtaining data from other sources, such as municipalities or respective geographic authorities. In addition, the map developer can employ field personnel to travel by vehicle along roads throughout the geographic region to observe features and/or record information about them, for example. Also, remote sensing, such as aerial or satellite photography, can be used.

The geographic database can be a master geographic database stored in a format that facilitates updating, maintenance, and development. For example, the master geographic database or data in the master geographic database can be in an Oracle spatial format or other spatial format, such as for development or production purposes. The Oracle spatial format or development/production database can be compiled into a delivery format, such as a geographic data files (GDF) format. The data in the production and/or delivery formats can be compiled or further compiled to form geographic database products or databases, which can be used in end user navigation devices or systems.

For example, geographic data is compiled (such as into a platform specification format (PSF) format) to organize and/or configure the data for performing navigation-related functions and/or services, such as route calculation, route guidance, map display, speed calculation, distance and travel time functions, and other functions. The navigation-related functions can correspond to vehicle navigation or other types of navigation. The compilation to produce the end user databases can be performed by a party or entity separate from the map developer. For example, a customer of the map developer, such as a navigation device developer or other end user device developer, can perform compilation on a received geographic database in a delivery format to produce one or more compiled navigation databases. Regardless of the manner in which the databases are compiled and maintained, a navigation system that embodies an apparatus 10 in accordance with an example embodiment may determine the time to traverse a route that includes one or more turns at respective intersections more accurately.

IV. APPARATUS, METHODS, AND COMPUTER PROGRAM PRODUCTS

As described above, FIGS. 4 and 5 illustrate flowcharts of apparatus 10, method, and computer program product according to example embodiments of the invention. It will be understood that each block of the flowcharts, and combinations of blocks in the flowcharts, may be implemented by various means, such as hardware, firmware, processor, circuitry, and/or other devices associated with execution of software including one or more computer program instructions. For example, one or more of the procedures described above may be embodied by computer program instructions. In this regard, the computer program instructions which embody the procedures described above may be stored by the memory device 14 of an apparatus employing an embodiment of the present invention and executed by the processor 12 of the apparatus. As will be appreciated, any such computer program instructions may be loaded onto a computer or other programmable apparatus (e.g., hardware) to produce a machine, such that the resulting computer or other programmable apparatus implements the functions specified in the flowchart blocks. These computer program instructions may also be stored in a computer-readable memory that may direct a computer or other programmable apparatus to function in a particular manner, such that the instructions stored in the computer-readable memory produce an article of manufacture the execution of which implements the function specified in the flowchart blocks. The computer program instructions may also be loaded onto a computer or other programmable apparatus to cause a series of operations to be performed on the computer or other programmable apparatus to produce a computer-implemented process such that the instructions which execute on the computer or other programmable apparatus provide operations for implementing the functions specified in the flowchart blocks.

Accordingly, blocks of the flowcharts support combinations of means for performing the specified functions and combinations of operations for performing the specified functions for performing the specified functions. It will also be understood that one or more blocks of the flowcharts, and combinations of blocks in the flowcharts, can be implemented by special purpose hardware-based computer systems which perform the specified functions, or combinations of special purpose hardware and computer instructions.

In some embodiments, certain ones of the operations above may be modified or further amplified. Furthermore, in some embodiments, additional optional operations may be included. Modifications, additions, or amplifications to the operations above may be performed in any order and in any combination.

Many modifications and other embodiments of the inventions set forth herein will come to mind to one skilled in the art to which these inventions pertain having the benefit of the teachings presented in the foregoing descriptions and the associated drawings. Therefore, it is to be understood that the inventions are not to be limited to the specific embodiments disclosed and that modifications and other embodiments are intended to be included within the scope of the appended claims. Moreover, although the foregoing descriptions and the associated drawings describe example embodiments in the context of certain example combinations of elements and/or functions, it should be appreciated that different combinations of elements and/or functions may be provided by alternative embodiments without departing from the scope of the appended claims. In this regard, for example, different combinations of elements and/or functions than those explicitly described above are also contemplated as may be set forth in some of the appended claims. Although specific terms are employed herein, they are used in a generic and descriptive sense only and not for purposes of limitation.

That which is claimed:

1. A method comprising:

receiving, by an apparatus comprising at least one processor and a communication interface, one or more measurements of one or more weather parameters for a geographic area, the geographic area represented by a plurality of tiles;

processing, by the apparatus, at least one of the measurements of at least one of the one or more weather parameters to determine a dangerous driving weather score for at least a first tile of the plurality of tiles;

identifying, by the apparatus, that the first tile of the plurality of tiles is experiencing dangerous driving weather based on the dangerous driving weather score for the first tile;

identifying, by the apparatus, one or more second tiles that are experiencing dangerous weather based on the dangerous driving weather score corresponding to each of the one or more second tiles, wherein (a) the one or more second tiles are each adjacent to the first tile and (b) the dangerous driving weather score corresponding to each of the one or more second tiles is determined based on weather conditions of the second tile;

responsive to identifying the one or more second tiles that are experiencing dangerous weather, defining, by the apparatus, a cluster, the cluster comprising the first tile and the one or more second tiles, generating, by the apparatus, a dangerous driving weather message corresponding to the cluster, the dangerous driving weather message comprising a timestamp, a list of one or more affected tile identifiers, an alert type, and alert information, wherein the list of one or more affected tile identifiers comprises a tile identifier for each tile of the cluster; and providing, by the apparatus, the dangerous driving weather message, wherein at least a portion of the dangerous driving weather message is configured to be provided via a user interface of a mobile device.

2. A method according to claim 1, further comprising:

identifying one or more tiles adjacent to the cluster that are identified as experiencing dangerous driving weather; and adding the one or more tiles adjacent to the cluster that are identified as experiencing dangerous driving weather to the cluster.

3. A method according to claim 1, further comprising:

identifying one or more nearby tiles that are identified as experiencing dangerous driving weather; and adding (a) the one or more nearby tiles that are identified as experiencing dangerous driving weather and (b) at least one adjoining tile corresponding to each nearby tile identified as experiencing dangerous driving weather to the cluster, wherein (a) an adjoining tile is a tile that shares (i) at least one boundary with a tile in the cluster and (ii) a boundary with a nearby tile and (b) a nearby tile is a tile that (i) does not share a boundary with a tile in the cluster and (ii) does share a boundary with an adjoining tile.

4. A method according to claim 1, wherein the alert information comprises at least one statistical representation of the severe weather being experienced in the area represented by the cluster.

5. A method according to claim 1, wherein the dangerous driving weather score for the first tile is greater than a corresponding single condition score threshold value, the dangerous driving weather score for the first tile determined based on one weather condition for the first tile.

6. A method according to claim 1, wherein the dangerous driving weather score for the first tile is greater than a corresponding combined condition score threshold value, the dangerous driving weather score for the first tile determined based on a combination of two or more weather conditions for the first tile.

7. A method according to claim 1, wherein the dangerous driving weather message is configured to expire after a predetermined time period.

8. A method according to claim 7, wherein the mobile device is expected to enter the first tile or one of the one or more second tiles before the dangerous driving weather message expires.

9. A method according to claim 1, wherein the dangerous driving weather message is provided to an intermediary system for distribution to a mobile device based on at least one tile identifier listed in the list of one or more affected tile identifiers and a location of the mobile device, wherein the mobile device is associated with the intermediary system.

10. A method according to claim 1, wherein the dangerous driving weather message is provided to a mobile device based on a current physical location of the mobile device and at least one tile identifier listed in the list of one or more affected tile identifiers.

11. An apparatus comprising at least one processor, a communication interface, and at least one memory storing computer program code, the at least one memory and the computer program code configured to, with the processor, cause the apparatus to at least:

receive, via the communication interface, one or more measurements of one or more weather parameters for a geographic area, the geographic area represented by a plurality of tiles;

process at least one of the measurements of at least one of the one or more weather parameters to determine a dangerous driving weather score for at least a first tile of the plurality of tiles;

identify that the first tile of the plurality of tiles is experiencing dangerous driving weather based on the dangerous driving weather score for the first tile;

identify one or more second tiles that are experiencing dangerous weather based on the dangerous driving weather score corresponding to each of the one or more second tiles, wherein (a) the one or more second tiles are each adjacent to the first tile and (b) the dangerous driving weather score corresponding to each of the one or more second tiles is determined based on weather conditions of the second tile;

responsive to identifying the one or more second tiles that are experiencing dangerous weather, define a cluster, the cluster comprising the first tile and the one or more second tiles, generate a dangerous driving weather message corresponding to the cluster, the dangerous driving weather message comprising a timestamp, a list of one or more affected tile identifiers, an alert type, and alert information, wherein the list of one or more affected tile identifiers comprises a tile identifier for each tile of the cluster; and provide, via the communication interface, the dangerous driving weather message, wherein at least a portion of the dangerous driving weather message is configured to be provided via a user interface of a mobile device.

12. An apparatus according to claim 11, wherein the at least one memory and the computer program code are further configured to, with the processor, cause the apparatus to at least:

identify one or more tiles adjacent to the cluster that are identified as experiencing dangerous driving weather; and add the one or more tiles adjacent to the cluster that are identified as experiencing dangerous driving weather to the cluster.

13. An apparatus according to claim 11, wherein the at least one memory and the computer program code are further configured to, with the processor, cause the apparatus to at least:

identify one or more nearby tiles that are identified as experiencing dangerous driving weather; and add (a) the one or more nearby tiles that are identified as experiencing dangerous driving weather and (b) at least one adjoining tile corresponding to each nearby tile identified as experiencing dangerous driving weather to the cluster, wherein (a) an adjoining tile is a tile that shares (i) at least one boundary with a tile in the cluster and (ii) a boundary with a nearby tile and (b) a nearby tile is a tile that (i) does not share a boundary with a tile in the cluster and (ii) does share a boundary with an adjoining tile.

14. An apparatus according to claim 11, wherein the alert information comprises at least one statistical representation of the severe weather being experienced in the area represented by the cluster.

15. An apparatus according to claim 11, wherein the dangerous driving weather score for the first tile is greater than a corresponding single condition score threshold value, the dangerous driving weather score for the first tile determined based on one weather condition for the first tile.

16. An apparatus according to claim 11, wherein the dangerous driving weather score for the first tile is greater than a corresponding combined condition score threshold value, the dangerous driving weather score for the first tile determined based on a combination of two or more weather conditions for the first tile.

17. An apparatus according to claim 11, wherein the dangerous driving weather message is provided to an intermediary system for distribution to a mobile device based on at least one tile identifier listed in the list of one or more affected tile identifiers and a location of the mobile device, wherein the mobile device is associated with the intermediary system.

18. An apparatus according to claim 11, wherein the dangerous driving weather message is provided to a mobile device based on a current physical location of the mobile device and at least one tile identifier listed in the list of one or more affected tile identifiers.

19. An apparatus according to claim 11, wherein the mobile device is expected to enter the first tile or one of the one or more second tiles before the dangerous driving weather message expires.

20. A computer program product comprising at least one non-transitory computer-readable storage medium having computer-executable program code instructions stored therein, the computer-executable program code instructions comprising program code instructions configured to:

receive one or more measurements of one or more weather parameters for a geographic area, the geographic area represented by a plurality of tiles;

process at least one of the measurements of at least one of the one or more weather parameters to determine a dangerous driving weather score for at least a first tile of the plurality of tiles;

identify that the first tile of the plurality of tiles is experiencing dangerous driving weather based on the dangerous driving weather score for the first tile;

identify one or more second tiles that are experiencing dangerous weather based on the dangerous driving weather score corresponding to each of the one or more second tiles, wherein (a) the one or more second tiles are each adjacent to the first tile and (b) the dangerous driving weather score corresponding to each of the one or more second tiles is determined based on weather conditions of the second tile;

responsive to identifying the one or more second tiles that are experiencing dangerous weather, define a cluster, the cluster comprising the first tile and the one or more second tiles, generate a dangerous driving weather message corresponding to the cluster, the dangerous driving weather message comprising a timestamp, a list of one or more affected tile identifiers, an alert type, and alert information, wherein the list of one or more affected tile identifiers comprises a tile identifier for each tile of the cluster; and provide the dangerous driving weather message, wherein at least a portion of the dangerous driving weather message is configured to be provided via a user interface of a mobile device.

* * * * *